US005284000A

United States Patent [19]

Milne et al.

[11] Patent Number: 5,284,000

[45] Date of Patent: Feb. 8, 1994

[54] AUTOMATING BRICKLAYING

[75] Inventors: W. Warren Milne, Toronto; Jacek A Wiercienski; Pawel Kuzan, both of Oakville, all of Canada

[73] Assignee: Redwall Engineering Corp., Toronto, Canada

[21] Appl. No.: 983,221

[22] Filed: Nov. 30, 1992

[51] Int. Cl.[5] ..... E04G 21/14

[52] U.S. Cl. ..... 52/749

[58] Field of Search ..... 52/749, 122.1

[56] References Cited

U.S. PATENT DOCUMENTS

| | | | |
|---|---|---|---|
| 28,305 | 1/1875 | Williamson et al. | 52/749 |
| 1,277,777 | 9/1918 | Thomson | 52/749 |
| 1,606,001 | 11/1926 | Thomson | 52/749 |
| 1,686,279 | 10/1928 | Kaye | 52/749 |
| 1,843,092 | 1/1932 | Massen | 52/749 |
| 2,599,552 | 6/1952 | Harney | 52/749 |
| 3,177,621 | 4/1965 | Demarest | 52/749 |
| 3,325,960 | 6/1967 | James | 52/749 |
| 3,350,833 | 11/1967 | Larger | 52/749 |
| 3,382,640 | 5/1968 | Thomas et al. | 52/749 |
| 3,438,171 | 4/1969 | Deamrest | 52/749 |
| 3,659,392 | 5/1972 | Stoltz | 52/749 |
| 3,782,047 | 1/1974 | Stoltz | 52/749 |

*Primary Examiner*—Carl D. Friedman
*Assistant Examiner*—Beth A. Aubrey
*Attorney, Agent, or Firm*—Mirek A. Waraksa

[57] ABSTRACT

Bricklaying equipment includes a guideway extending along brick masonry being erected. A bricklaying machine displaces along the guideway. It has a robotic arm with an upper arm and a forearm. The upper arm pivots about a shoulder joint, and the forearm pivots relative to the upper arm at an elbow joint. A wrist joint permits a tool assembly, including a mortar-dispensing mechanism and a brick-gripping mechanism, to pivot relative to the forearm. The mortar-dispensing mechanism includes a form that receives and shapes a mortar charge, and a sliding gate mechanism that discharges the shaped charge. The arm is operated with a single motor that pivots the upper arm. Linkage constrains the tool assembly to move along a horizontal axis as the upper arm pivots and to remain in a fixed angular orientation relative to vertical. The arm is operated in response to sensors that detect vertical and horizontal distances to a mason's line. Brick and mortar carriers are also mounted to the guideway, and travel between loading areas and brick-and mortar-transferring positions relative to the bricklaying machine.

35 Claims, 9 Drawing Sheets

FIG. 4
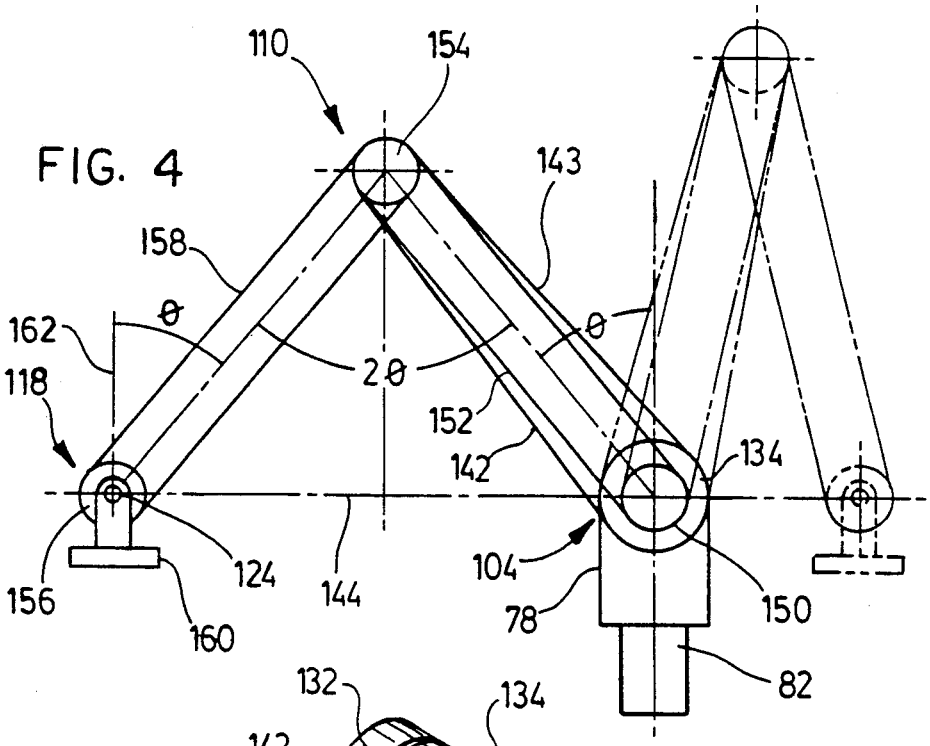
FIG. 5
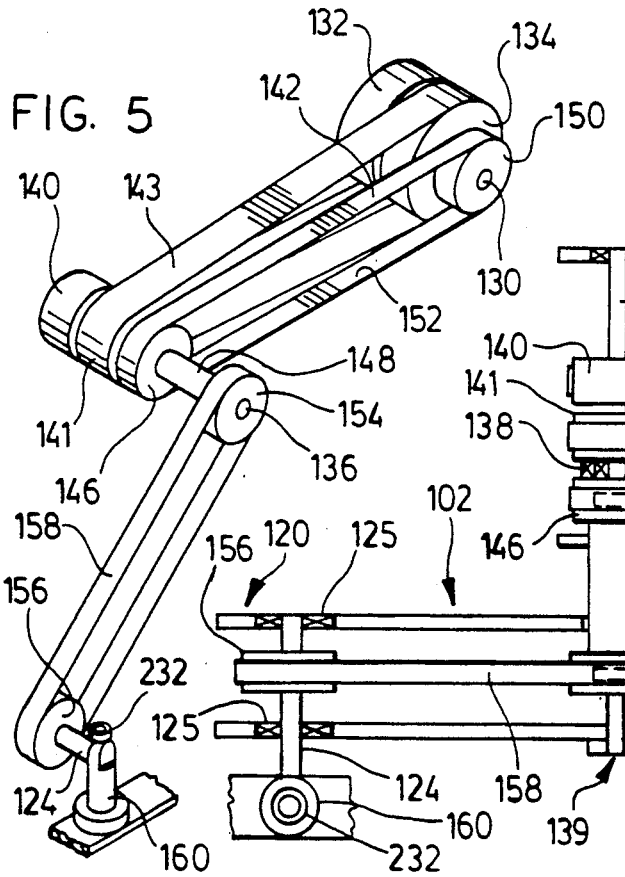
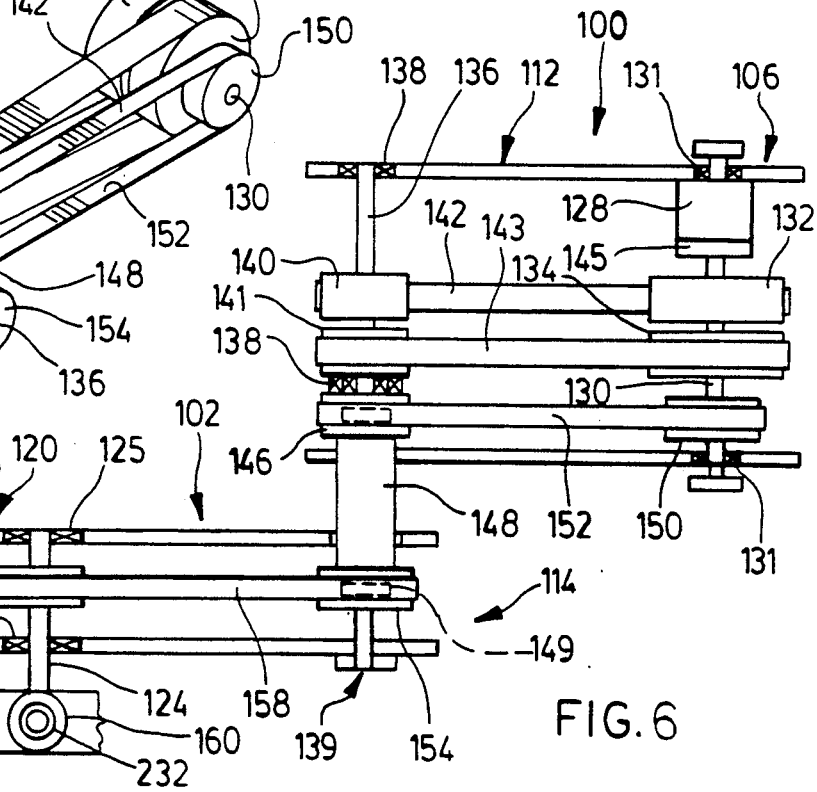
FIG. 6

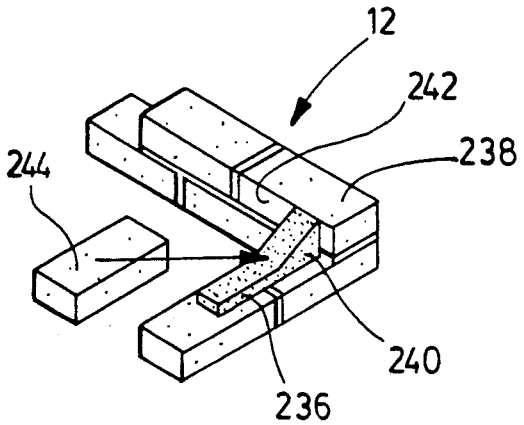
FIG. 14
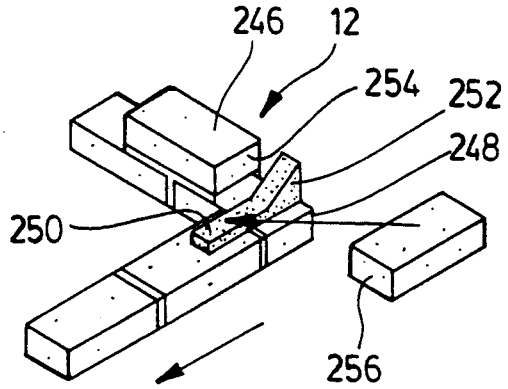
FIG. 15
FIG. 16
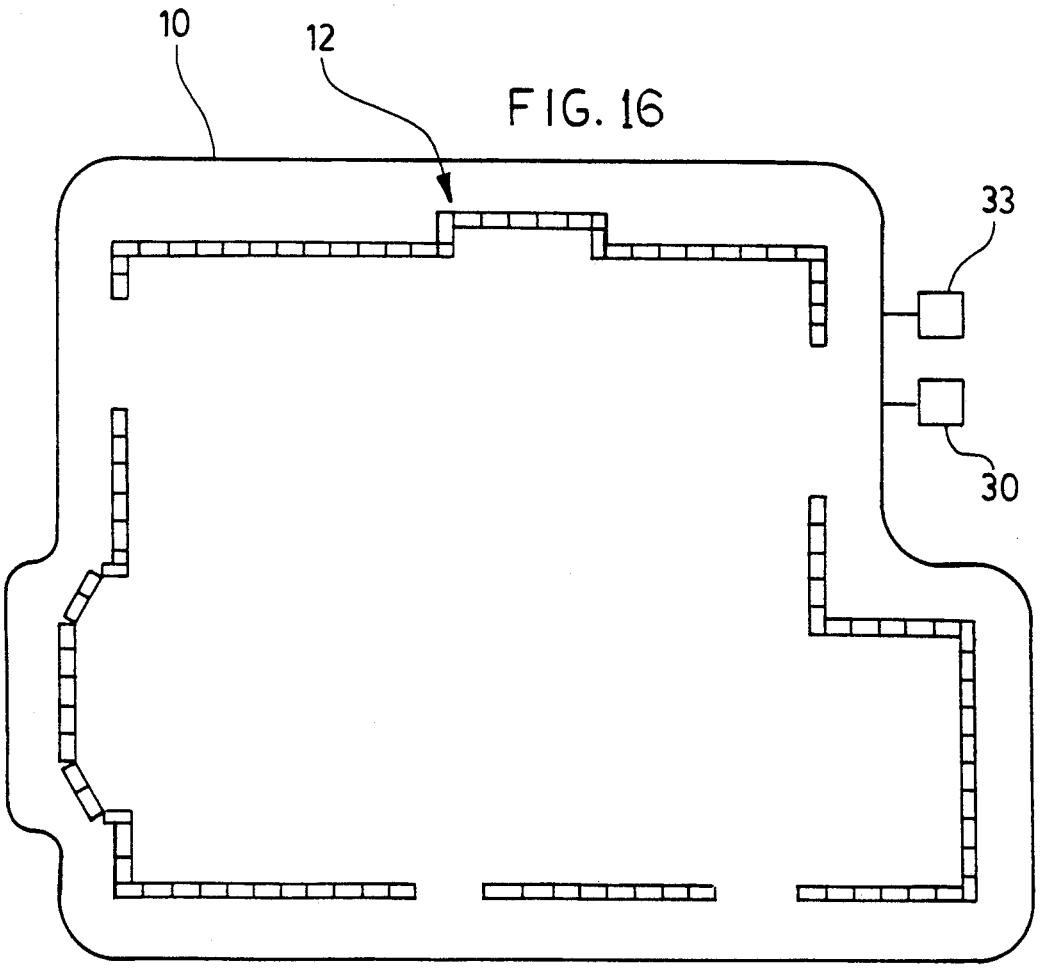

AUTOMATING BRICKLAYING

FIELD OF THE INVENTION

The invention relates to methods and apparatus for automating bricklaying.

BACKGROUND OF THE INVENTION

Automated bricklaying machinery was proposed in U.S. Pat. No. 4,060,955, granted on Dec. 6, 1977 to Lachnit. The machinery includes a main carriage that rolls on horizontal tracks. The main carriage supports a bricklaying machine and a pallet bearing a large supply of stacked bricks. The bricklaying machine has a frame that displaces vertically on uprights fixed to the main carriage. The frame supports a magazine that contains a single vertical stack of bricks, and also supports a pair of horizontal rails. The horizontal rails in turn support a secondary carriage to which a brick-gripping mechanism and a mortar injector are mounted. In operation, the secondary carriage is first positioned beside the brick magazine. A hydraulically-operated lever mechanism transfers a single brick from the magazine to the brick gripper. The secondary carriage then travels along the horizontal rails until the mortar injector and the brick gripper are appropriately positioned to apply mortar and place the gripped brick beside the current flight. When the magazine is empty, another hydraulically-operated mechanism grips a row of bricks on the pallet and reorients the row as a vertical stack in the magazine.

There are several shortcomings to the proposed machinery. Dispensing mortar under pressure is not reliable in an automated process, as mortar has a tendency to clog pumps and conduits. Also, vertical joints between bricks cannot be readily filled. The machinery also requires excessive brick handling. Bricks must be stacked on a pallet, then re-stacked in a magazine, and finally transferred to a brick gripper. The apparatus is also very dependent on precise leveling and positioning of the rails supporting the main carriage.

A variety of robotic mechanisms for placing concrete blocks are canvassed in an article by Slocum and Shena entitled "Blockbot: A Robot To Automate Construction Of Cement Block Walls", published in Robotics & Automation Systems, v. 4, No. 2, June, 1988. One robotic mechanism described in the article includes an arm assembly somewhat similar to that proposed in the present specification. It has an upper arm and a forearm together with appropriate shoulder, elbow and wrist joints that pivot about parallel horizontal axes. The wrist joint supports a block-gripping mechanism. Such an arm assembly is dismissed as having insufficient stiffness and load-bearing capacity and as requiring excessively complex control.

The article suggests use of a robotic arm with a single horizontal arm member. The arm member swings about a vertical axis at a shoulder joint, and the shoulder joint can itself be raised and lowered on a vertical track. A wrist joint between the arm and a block gripping mechanism allows only pivoting of the gripping mechanism about a vertical axis. The robotic arm is mounted on a horizontal track fixed to a wheeled carriage. The carriage has a platform on which a store of individual blocks is rested. In operation, the carriage is moved to a desired location and kept stationary. The arm assembly displaces horizontally along the track in increments correspond to successive block positions in the masonry being constructed. The arm swings horizontally over the platform and lowers to receive a block. The arm then raises, swings horizontally to locate the block over the masonry, and lowers to seat the block on the masonry.

The article proposes that blocks be stacked dry. It suggests that a bonding layer be formed over the exterior of the resulting masonry. There are several shortcomings, however. Precision blocks may be required as there is no bonding composition between blocks to accommodate variations in size. Also, bricks are preferred to blocks largely for esthetic reasons, and placing a bonding layer over brick masonry defeats the basic purpose for using bricks. A number of issues are not adequately addressed, such as how to align the carriage when moved to successive positions along the masonry, and how to supply blocks to the block laying machinery.

The present specification addresses several problems relating to automation of bricklaying. These relate to mortar application, appropriate construction of a robotic arm assembly, how to conveniently supply mortar and bricks to automated bricklaying equipment, and reducing sensitivity of such equipment to variations in the orientation of a guideway or track.

BRIEF SUMMARY OF THE INVENTION

In one aspect, the invention provides a machine for use in laying bricks on brick masonry. The machine has a support frame which preferably displaces along a guideway beside the masonry being erected. The machine has a tool assembly with a controllable mechanism for gripping a brick and a mechanism for dispensing mortar. The mortar-dispensing mechanism includes a form for receiving and shaping a charge of mortar. A closure mechanism is operable to release the shaped mortar charge through a discharge opening in the form. Controllable displacing means move the tool assembly relative to the frame, permitting bricks and mortar charges to be repeatedly received and placed on the brick masonry. The displacing means preferably comprise a pivoting robotic arm.

The mortar-dispensing mechanism preferably comprises a gate mounted for sliding movement relative to the form's discharge opening. Means are provided for sliding the gate between a closed orientation supporting the mortar charge and an open orientation releasing the mortar charge. The form preferably has an elongate circumferential sidewall with a pair of end walls, corresponding generally to the peripheral shape of a brick. The form may be shaped to accumulate the mortar change to a greater depth proximate to one end wall. This permits the contained mortar to be deposited to a greater depth proximate to the last brick laid in the current flight. The next brick can then be appropriately manipulated to force the deposited mortar to fill the vertical gap otherwise occurring between the two bricks, as explained more fully in the description of preferred embodiments.

In another aspect, the invention addresses the problem of supplying bricks and mortar to a bricklaying machine. As mentioned above, the frame of the bricklaying machine is preferably displaceable along a guideway. A brick carrier is mounted to the guideway for travel to and from a brick-transferring position relative to the bricklaying machine. A mortar carrier may be mounted to the guideway for travel to and from a mortar-transferring position relative to the bricklaying machine. The brick and mortar carriers may travel to a predetermined location where bricks and mortar are stored and workers can manually load the carriers.

In another aspect, the bricklaying apparatus is made responsive to a horizontal datum located above the masonry, such as a conventional mason's line. The horizontal distance of the tool assembly components from the frame may be determined with first sensing means responsive to operation of the displacing means, such as optical associated with drive motors. Second sensing means, preferably an ultrasonic detector, sense the horizontal distance from the frame to the datum. Controls operate the displacing means in response to the first and second sensing means to position tool assembly components for deposition of mortar or laying of bricks. This reduces the need for precise positioning of the guideway horizontally and parallel to the masonry. Sensing means may also be provided that displace with the tool assembly and sense the vertical distance from tool assembly components to the datum, and the controls may position tool assembly components in response to the sensed vertical distance. This reduces the need for precise leveling of the guideway.

In another aspect, the displacing means comprise a robotic arm assembly. The arm assembly includes a support, which is preferably mounted to the frame for vertical displacement and horizontal swinging. It also includes first and second arm members. A first pivot joint permits the first arm member to pivot relative to the support about a first horizontal pivot axis, and motor means can be operated to produce such pivoting. A second pivot joint permits the second arm member to pivot about a second pivot axis substantially parallel to the first pivot axis. A third pivot joint permits the tool assembly to pivot about a third axis substantially parallel to the first and second axes. Linkage means couple the arm members such that the third pivot joint is constrained to displace substantially along a predetermined axis extending transversely through the first pivot axis.

The arm assembly effectively defines a shoulder, an upper arm and a forearm together with shoulder, elbow, and wrist joints that permit components to pivot about parallel horizontal axes. In typical use, the linkage means constrain the wrist joint and the tool assembly to displace horizontally as the upper arm pivots about the shoulder. Control is greatly simplified and only a single motor is required for extension or retraction. The linkage means may also couple the pivot joints to maintain the tool assembly in a fixed angular relationship relative to vertical as the arm assembly extends or retracts, further simplifying control. The arm assembly can also be stiffened by using flexible straps of relatively non-extensible material to pivot the forearm, as described more fully below.

Other aspects of the invention will be apparent from a description of preferred embodiments below and will be more specifically defined in the appended claims.

DESCRIPTION OF THE DRAWINGS

The invention will be better understood with reference to drawings in which:

FIG. 4 diagrammatically illustrates how an arm assembly associated with the bricklaying machine displaces;

FIG. 5 is a diagrammatic perspective view of certain components contained within the arm assembly;

FIG. 6 is a diagrammatic plan view of various components within the arm assembly;

FIGS. 14 and 15 show alternative ways of placing a brick at corners of masonry to spread a deposited mortar charge to fill vertical spaces between bricks;

FIG. 16 diagrammatically illustrates a construction site at which a guideway has been installed for the bricklaying machine, the brick train and the mortar carrier;

DESCRIPTION OF PREFERRED EMBODIMENT

Figure 1:
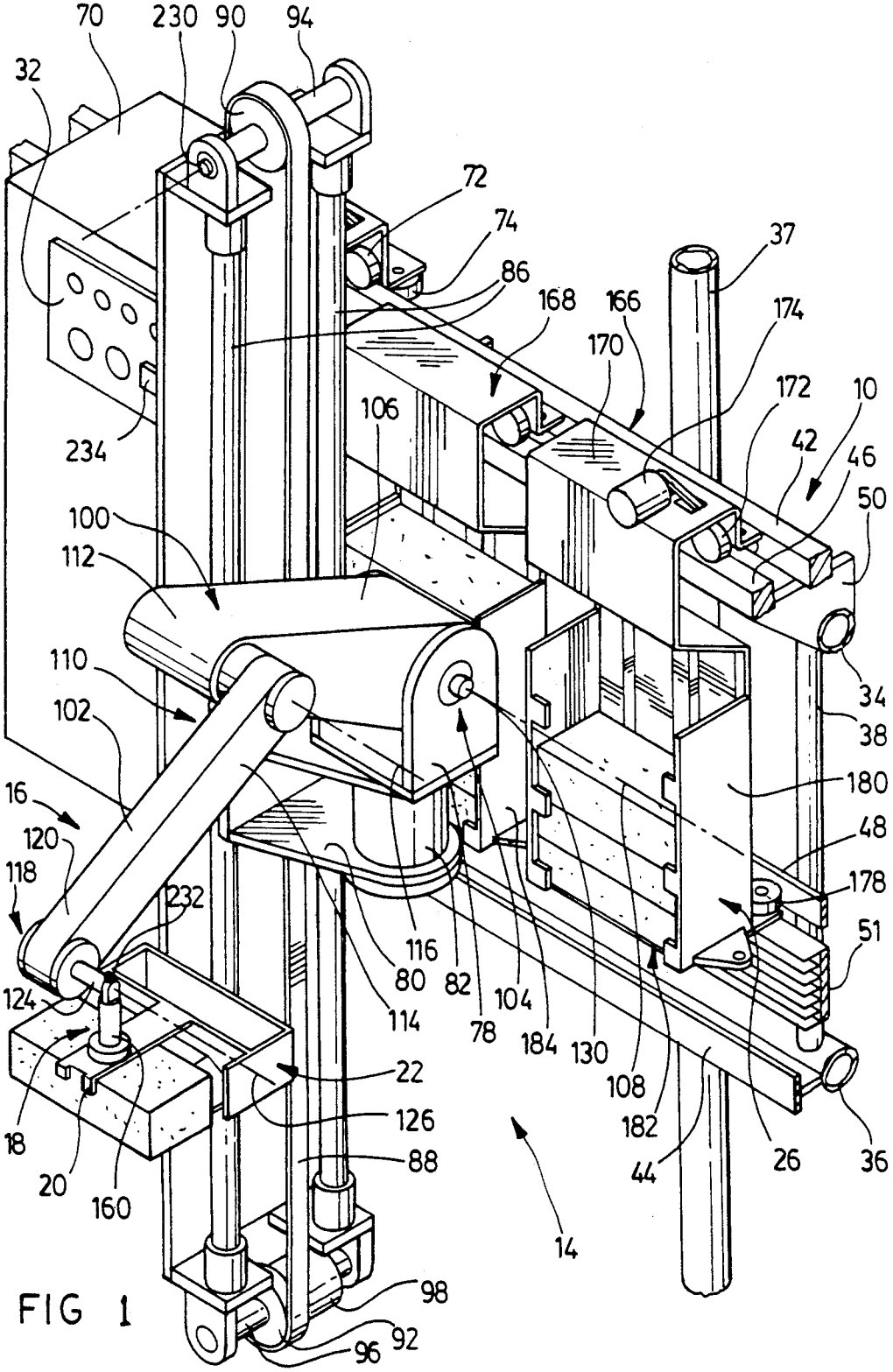
FIG. 1 is a perspective view of a bricklaying machine and a brick train which supplies brick to the machine.
Figure 2:
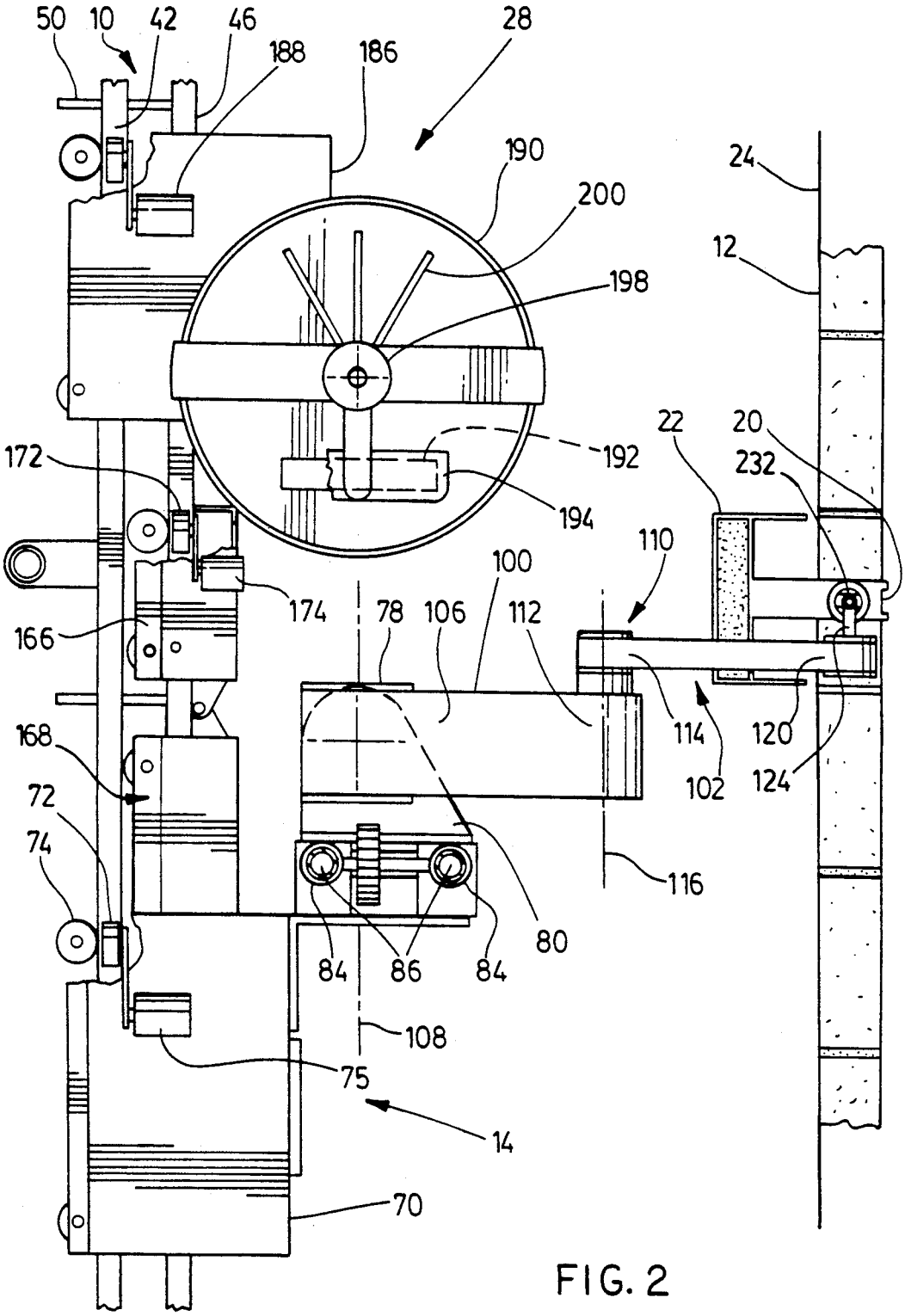
FIG. 2 is a plan view of the bricklaying machine, the brick train and also a mortar carrier.

An overview of equipment for automating bricklaying will be provided with reference primarily to FIGS. 1 and 2. The equipment includes a horizontal guideway 10, which may extend fully about brick masonry 12 that is to be erected (as illustrated in FIG. 16). A bricklaying machine 14 travels along the guideway 10. It has an arm assembly 16 that supports a tool assembly 18. The tool assembly 18 includes a brick-gripping mechanism 20 and a mortar-dispensing mechanism 22. The bricklaying machine 14 is guided in part by a mason's line 24. It repeatedly retrieves a single mortar charge and a single brick, depositing the mortar charge on the brick masonry 12 and then placing the brick onto the mortar. A brick train 26 and a mortar carrier 28 travel along guideway 10. These transfer bricks and mortar from a predetermined storage location 30 to the bricklaying machine 14. The guideway 10 is adapted to supply electricity, cooperate in sensing the position of each machine, and to permit transfer of control signals among the bricklaying machine 14, the brick train 26 and mortar carrier 28. A controller 32 associated with the bricklaying machine 14 may be programmed to continuously lay bricks to construct a predefined structure and also to control the operation of the brick train 26 and mortar carrier 28 to supply bricks and mortar as required. Operations may be monitored and replenishment of the brick train 26 and mortar carrier 28 may may be controlled in whole or in part at a control station 33.

The guideway 10 has a track-supporting structure with a ladder-like construction. The supporting structure has upper and lower horizontal pipes 34, 36 joined by vertical pipes, such as the pipe 38 apparent in FIGS. 1 and 3. The horizontal pipes 34, 36 may be secured with conventional clamps (such as the clamps 40) to uprights of a scaffold 37. A first pair of upper and lower rails 42, 44 are used to support the bricklaying machine 14 and the mortar carrier 28. A second pair of upper and lower rails 46, 48 are used to support the brick train 26. The upper rails 42, 46 are attached by triangular brackets 50 to the upper horizontal pipe 34. The lower rail 48 associated with the brick train 26 is secured to the vertical pipes. The other lower rail 44 is connected in spaced relationship to the lower horizontal pipe. The overall arrangement is such that the brick train 26 can pass between the guideway 10 and either the bricklaying machine 14 or the mortar carrier 28, despite mounting of all components to one lateral side of the guideway 10. The guideway 10 may have a modular construction allowing sections to be joined end-to-end.

The guideway 10 carries a plastic casing 51 that defines separate channels in which communication and power bars are located. Two power bars 52, 54 supply electric power to the bricklaying machine 14 and to the mortar carrier 28. Another pair of power bars 56, 58 supply power to the brick train 26. The power 52 bar is magnetically encoded to serve as a distance indicator for the bricklaying machine 14 and mortar carrier 28. It is encoded at one-eighth inch intervals, allowing for sensing of incremental changes in position. The power bar 56 is similarly configured to serve as a distance indicator for the brick train 26. Two conductors 60, 62 are used for communications, one for the bricklaying machine 14 and mortar carrier 28, and another for the brick train 26. These conductors 60, 62 are in separate channels, but are electrically connected for transfer of signals. Separate power and communication conductors are used to allow the brick train 26 to pass between the guideway 10 and either the bricklaying machine 14 or the mortar carrier 28. The power bars and communication conductors are contacted with sliding, spring-biased shoe assemblies attached to the respective machines. One such assembly is diagrammatically illustrated in association with the brick train 26 in FIG. 3 and indicated generally with the reference numeral 64. One of the shoes on each machine includes a transducer for sensing the magnetic encoding of a contacted power bar. Such components are conventional and have been used, for example, in the operation of gantry cranes. They will consequently not be described further.

The bricklaying machine 14 has a steel support frame or carriage 70 displaceable along the guideway 10. The carriage 70 is mounted with upper rollers 72, 74 to the upper rail 42 of the guideway 10. One such roller 72 is vertically oriented and driven by an electric motor 75 to propel the carriage 70 along the guideway 10. The other roller 74 is horizontally oriented and bears horizontally against the upper rail 42 to maintain the carriage 70 on the guideway 10. The carriage 70 is mounted to the lower rail 44 by another horizontally oriented roller (not illustrated). Additional rollers of similar orientation are present, but are not apparent in the drawings.

The arm assembly 16 includes a clevis-like support 78. The support 78 is mounted to a frame 80 for rotation about a vertical axis. A motor 82 attached to the frame 80 is operable to rotate the support 78. The frame 80 is in turn mounted with linear bearings 84 to two parallel vertical shafts 86. An endless toothed belt 88 (internal teeth not indicated) is located between the two shafts 86. The belt 88 is supported by upper and lower sprockets 90, 92. The upper sprocket 90 is fixed to an axle 94 supported for rotation between the tops of the two vertical shafts 86. The lower sprocket 92 is similarly fixed to an axle 96 that extends between the bottoms of the two shafts 86. The frame 80 is attached to the endless belt 88, and a motor 98 rotates the lower sprocket 92, effectively causing the frame 80 to be raised or lowered. The manner in which the support 78 is secured to the carriage 70 permits two degrees of freedom of movement of the arm assembly 16 and consequently the tool assembly 18: displacement vertically along a predetermined axis and horizontal swinging about that axis. Conventional optical encoders (not illustrated) associated with the motors 82, 98 provide signals indicating, after conventional processing, the vertical position and angular orientation of the arm assembly 16.

The arm assembly 16 is further detailed in the views of FIGS. 4–6 where dimensions and spacing between components have been somewhat exaggerated for purposes of illustration. To make the following description of the arm assembly 16 more meaningful, it will be described by analogy to the human arm in its normal lowered orientation relative to the human body. The terms "upper" and "lower" should be understood accordingly, rather than with reference to any particular orientation seen in the drawings.

The arm assembly 16 comprises an upper arm 100 and a forearm 102 in side-by-side relationship in parallel vertical planes. These components are essentially hollow casings. A first pivot joint 104, effectively a shoulder joint, is formed between the support 78 and an upper end 106 of the upper arm 100. It allows the upper arm 100 to pivot about a first horizontal axis 108. A second pivot joint 110, effectively an elbow joint, is formed between a lower end 112 of the upper arm 100 and an upper end 114 of the forearm 102. The elbow joint 110 allows the forearm 102 to pivot about a second horizontal pivot axis 116 substantially parallel to the first pivot axis 108. A third pivot joint 118, effectively a wrist joint, is formed between a lower end 120 of the forearm 102 and the frame 122 of the tool assembly 18. The wrist joint 118 includes a wrist shaft 124 mounted with a pair of bearings 125 for rotation within the lower end 120 of the forearm 102. This permits the tool assembly 18 to pivot about a third horizontal pivot axis 126 substantially parallel to the first and second pivot axes 108, 116.

The arm assembly 16 is extended and retracted with a single motor 128 at the shoulder joint 104. Linkage described more fully below constrains movement of the arm members so that the pivot axis 126 at the wrist joint 118 always remains substantially level with and parallel to the pivot axis 108 at the shoulder joint. Another linkage, also described more fully below, ensures that the tool assembly 18 remains in a fixed angular orientation relative to vertical at the wrist joint 118. This greatly simplifies control of the arm assembly 16. One advantage of the arm assembly 16 is that it can reach rearwardly, as indicated in phantom outline in FIG. 4. This permits a brick to be retrieved from the brick train 26 when the latter is positioned behind the bricklaying machine 14.

The linkage coupling the shoulder and elbow joints 104, 110 is apparent in FIGS. 5 and 6. The shoulder joint 104 includes a shoulder shaft 130 fixed to the support 78 in alignment with the first pivot axis 108. The upper end 106 of upper arm 100 is mounted with a pair of bearings 131 to the shoulder shaft 130. The motor 128 is stationary relative to the shoulder shaft 130 and connected to the upper arm end 106 to pivot the upper arm 100 about the first pivot axis 108. A pulley assembly comprising an identical pair of shoulder pulleys 132, 134 is fixed to the shoulder shaft 130 and effectively non-rotating. An elbow shaft 136 is aligned with the second pivot axis 116. The elbow shaft 136 is mounted with a pair of bearings 138 to the lower end 112 of the upper arm 100 (fixing of one of the bearings 138 in FIG. 6 to the arm 100 not being shown) for rotation about the second pivot axis 116. The elbow shaft 136 is also fixed to the upper end 114 of the forearm 102 at a location indicated with numeral 139 so that the two rotate together. Another pulley assembly comprises an identical pair of elbow pulleys 140, 141, fixed to the elbow shaft 136 for rotation therewith. They are coupled to the shoulder pulleys 132, 134 by a pair of flexible straps 142, 143 formed of high carbon spring steel, a material which strongly resists lengthwise-extension. Each strap 142 or 143 has one end fixed to the cylindrical surface defined by one of the shoulder pulleys 132, 134 and another end fixed to the cylindrical surface defined by one of the elbow pulley 140, 141, extending in a taut state. Each is positioned to a different side of a hypothetical plane (not illustrated) containing the first and second pivot axes 108, 116 associated with the shoulder and elbow joints 104, 110. Basically, as the motor 128 pivots the upper arm 100, the straps 142, 143 effectively rotate the elbow pulleys 140, 141 thereby rotating the elbow shaft 136 and pivoting the forearm 102. A toothed belt or chain might be used, but the straps 142, 143 considerably enhance the stiffness of the arm assembly 16.

The rest position of the arm assembly 16 may be considered a position in which the upper arm 100 and forearm 102 are vertically oriented in side-by-side relationship. The shoulder pulleys 132, 134 have a diameter which is twice that of the elbow pulleys 140, 141. Accordingly, when the upper arm 100 is pivoted about the shoulder joint 104 through a positive angular increment $\phi$, counter-clockwise in the view of FIG. 4, the forearm 102 is pivoted in response through a corresponding negative (clockwise) angular increment of $2\phi$ relative to the upper arm 100. The distance between the first and second pivot axes is substantially equal to the distance between the second and third pivot axes 116, 126. The net result is that the wrist joint 118 (more specifically the pivot axis 126 of the wrist joint 118) is constrained to displace along the horizontal axis 144 indicated in FIG. 4, which extends perpendicularly through the first pivot axis 108 of the shoulder joint 104. The horizontal position of the tool assembly 18 relative to the carriage 70 is a function of $\phi$, and a conventional optical encoder 145 associated with the shoulder motor 128 is used effectively to sense the current value of $\phi$.

Figure 7:
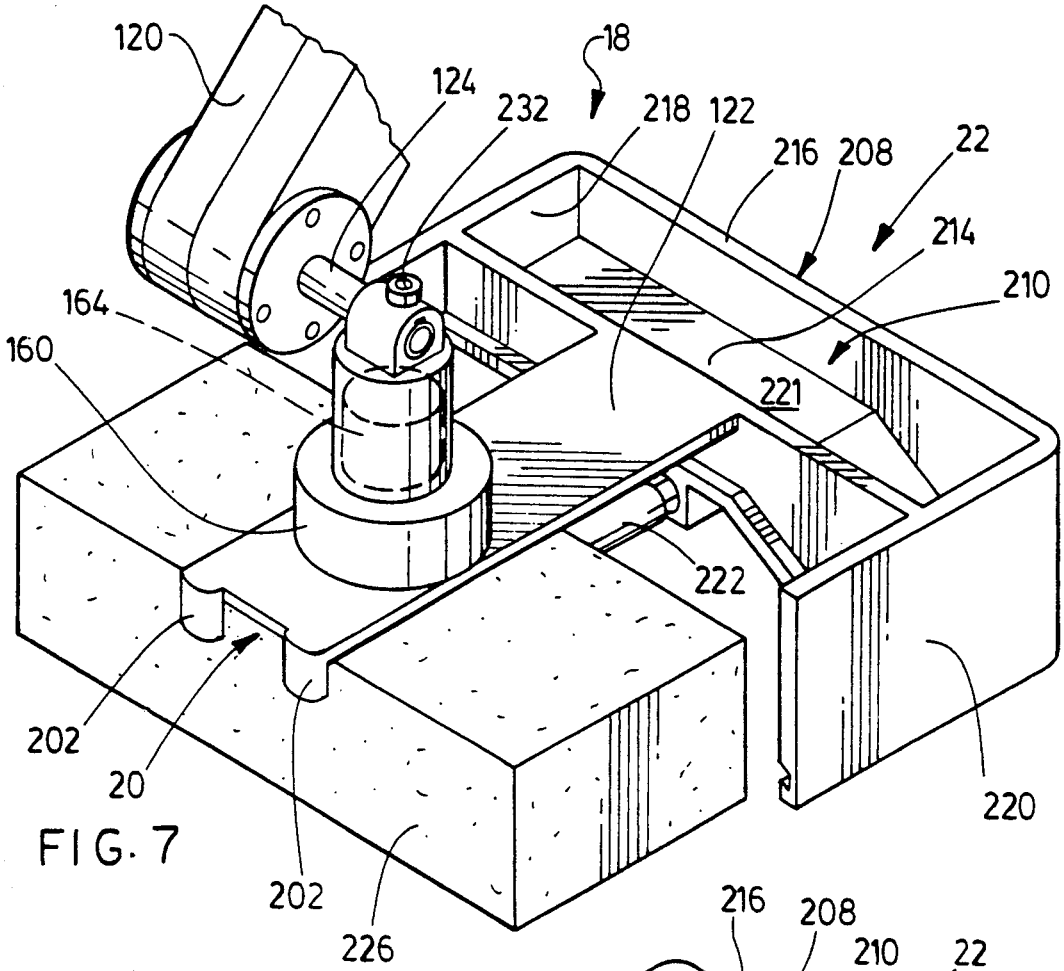
FIG. 7 is a perspective view of a tool assembly located at a wrist joint of the arm assembly.
Figure 8:
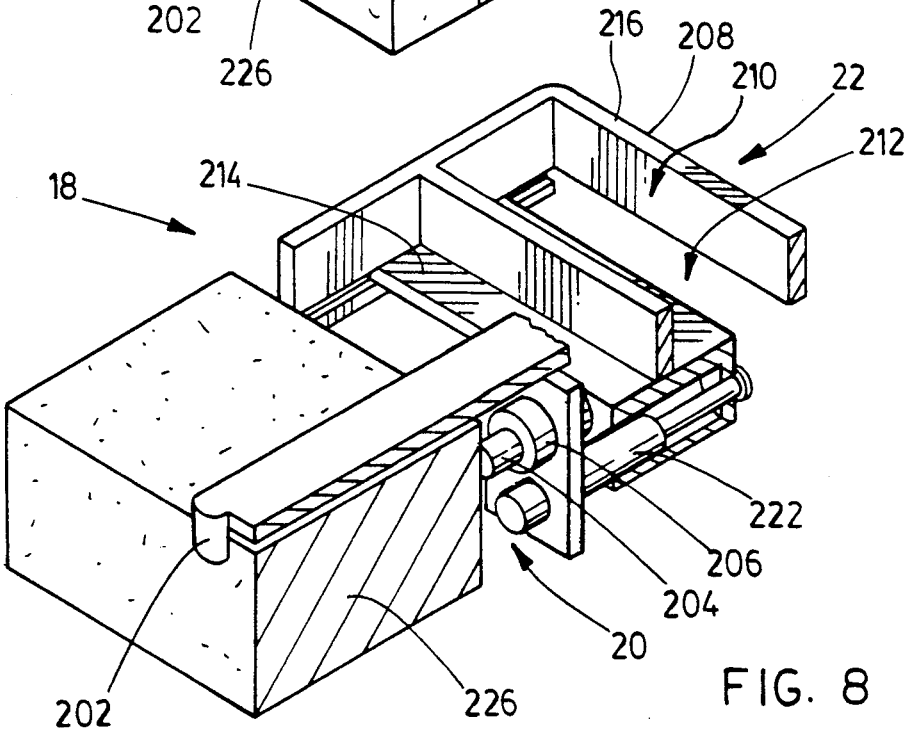
FIG. 8 corresponds to FIG. 7 fragmented to show further details of a brick-gripping mechanism and a mortar-dispensing mechanism.

The linkage which maintains the tool assembly 18 in a constant angular orientation relative to vertical will now be described. A third elbow pulley 146 is fixed to a sleeve 148. The sleeve 148 is mounted with a pair of bearings 149 (shown in phantom outline in FIG. 6) on the elbow shaft 136 (extending centrally through the interior of the sleeve 148) for relative rotation. Another shoulder pulley 150 is fixed to the shoulder shaft 130, and an endless toothed belt 152 couples the shoulder pulley 150 to the third elbow pulley 146. A pulley 154 in the upper end 114 of the forearm 102 is fixed to the sleeve 148 for rotation therewith, and a wrist pulley 156 is fixed to the wrist shaft 124. Another endless toothed belt 158 couples the pulleys 154, 156. The four pulleys 146, 150, 154, 156 have a common diameter. Thus, as the upper arm 100 is pivoted through the positive angular increment $\phi$, as in FIG. 4, about the first pivot axis 108 of the shoulder joint 104, the tool assembly 18 is pivoted by substantially the same positive angular increment $\phi$ about the third pivot axis 126 of the wrist joint 118. This maintains the orientation of the tool assembly 18 without reliance on any special control. The tool assembly 18 is actually connected to the wrist shaft 124 through a mounting assembly 160 (conventional for robotic mechanisms) that permits rotation of the tool assembly 18 about a vertical axis 162 centered relative to the brick-gripping mechanism 20. The mounting assembly 160 includes an internal motor 164 (indicated in phantom outline in FIG. 7) that can be operated to produce such rotation, and an appropriate optical encoder (not illustrated) to sense angular orientation relative to the vertical axis 162.

Pulley assemblies comprising paired shoulder pulleys 132, 134 and paired elbow pulleys 140, 141 are shown mounting the straps 142, 143. Pulley assemblies each consisting of a single pulley might be used. However, paired pulleys are desirable to facilitate installation and tightening of the straps 142, 143, whose ends are apt to be fastened to respective pulleys prior to installation.

Figure 3:
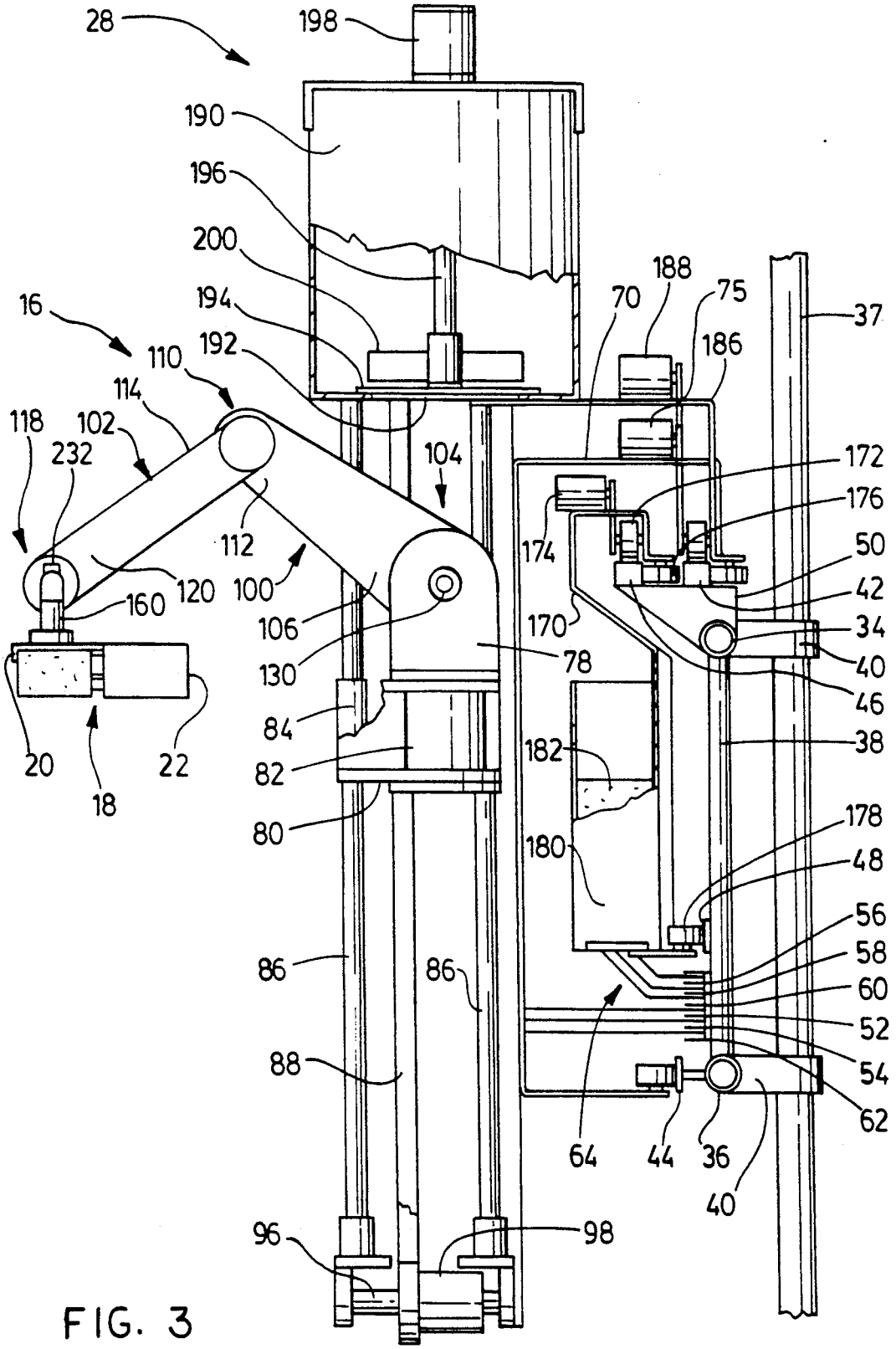
FIG. 3 is a partially fragmented side elevation of the bricklaying machine and the brick train.

The brick train 26 will be described primarily with reference to FIGS. 1 and 3. It includes a tractor unit 166 and a towed unit 168 which are articulated with a conventional joint 169. The tractor unit 166 comprises a steel carriage 170 which is mounted to the guideway 10 in substantially the same manner as the carriage 70 of the bricklaying machine 14, except rolling on upper and lower rails 46, 48. It has an upper vertical wheel 172 driven by a motor 174 to propel the carriage 170 along the guideway 10 and an upper horizontal wheel 176 bearing horizontally against the upper rail 46 for support. A lower horizontal wheel 178 bears against the lower rail 48. A brick retainer 180 is mounted to the carriage 170 and shaped to store up to five bricks 182 in a vertical stack. The towed unit 168 is similarly constructed, including another brick retainer 184, and mounted to the guideway 10, but relies on the tractor unit 166 to move along the guideway 10. The tractor unit 166 is currently shown in FIG. 1 in a brick-transferring position relative to the bricklaying machine 14. It may be so positioned in response to position signals from both the tractor unit 166 and the bricklaying machine 14, derived from the magnetically encoded power bars of the guideway 10, and to control signals derived from the conductors 60, 62. When the tractor unit 166 is empty, it may be moved along the guideway 10 to position the towed unit 168 for brick transfer.

The mortar carrier 28 will be described with reference to FIGS. 2, 3 and 10. It comprises a steel carriage 186 mounted to the guideway 10. The mounting is identical to that of the carriage 70 of the bricklaying machine 14 and consequently will not be described further. A motor 188 mounted on the carriage 186 propels the mortar carrier along the guideway 10. The carriage 186 also supports a shoe assembly (not illustrated) similar to that diagrammatically shown in association with the brick train 26, coupling the mortar carrier 28 to the power and communication bars of the guideway 10 for power supply, communication and position sensing. The position sensing permits the mortar carrier 28 to be positioned in a predetermined mortar-transferring orientation relative to the bricklaying machine 14, as in FIGS. 2 and 10.

The mortar carrier 28 has a container 190 for storing mortar. The container 190 has a discharge opening 192 in its bottom. A gate 194 is located within the container 190. The gate 194 is connected to a vertical shaft 196 extending centrally through the interior of the container 190. A motor 198 supported from the top of the container 190 is connected to the shaft 196, and can be actuated to rotate the shaft 196, displacing the gate 194 between a closed orientation (as in FIG. 2) and an open orientation allowing the stored mortar to discharge. A vane assembly 200 comprises three vanes that extend radially from the shaft 196, within the container 190. When the gate 194 is in its open orientation, the vanes 200 are positioned over the discharge opening 192. During discharging of mortar, the shaft 196 and vanes 200 are rotated in opposing angular directions about the central vertical axis of the shaft 196. The rotation may be through about 10 degrees and at a frequency of about 10 cycles per second. This agitates the stored mortar sufficiently to encourage a flow of mortar under gravity from the discharge opening 192. Excessive agitation should be avoided as the constituent components of the mortar will tend to separate.

The frame 122 of the tool assembly 18 is a relatively short strap-like member. The brick-gripping mechanism 20 comprises a pair of stationary fingers 202 extending downwardly from the frame 122. It also includes a single movable finger 204, which is displaced toward and away from the stationary fingers 202 by a hydraulic cylinder 206 mounted to the frame 122.

The mortar-dispensing mechanism 22 comprises a form 208 which is fixed to the frame 122. The form 208 has an upper opening 210 through which mortar can be received. It has a lower discharge opening 212 which is closed by a gate 214 conforming in shape to the bottom of the form 208. The form 208 has a circumferential sidewall 216, including a pair of horizontally spaced-apart end walls 218, 220, which shapes a received mortar charge 224 to correspond generally to the peripheral shape of a brick, allowing for spreading when deposited. The form 208 has a greater depth proximate to one end wall 220. The upper surface 221 of the gate 214, which supports the mortar charge, extends downwardly and laterally toward the end wall 220. This permits a mortar charge to be accumulated to a greater depth proximate to the particular end wall 220. A hydraulic cylinder 222 supported from the frame 122 slides the gate 214 between its closed orientation (as apparent in FIGS. 6, 10 and 11) to an open orientation (as apparent in FIG. 12), releasing the contained mortar charge. Although a variety of gate mechanisms with one or more gates might be used, a sliding gate mechanism is preferred. Since the gate 214 slides relative to the form 208, mortar on its upper surface 221 tends to be scraped from the gate 214 by the bottom of the form. This ensure that mortar does not harden onto the gate 214 and eventually affect operation.

Figure 10:
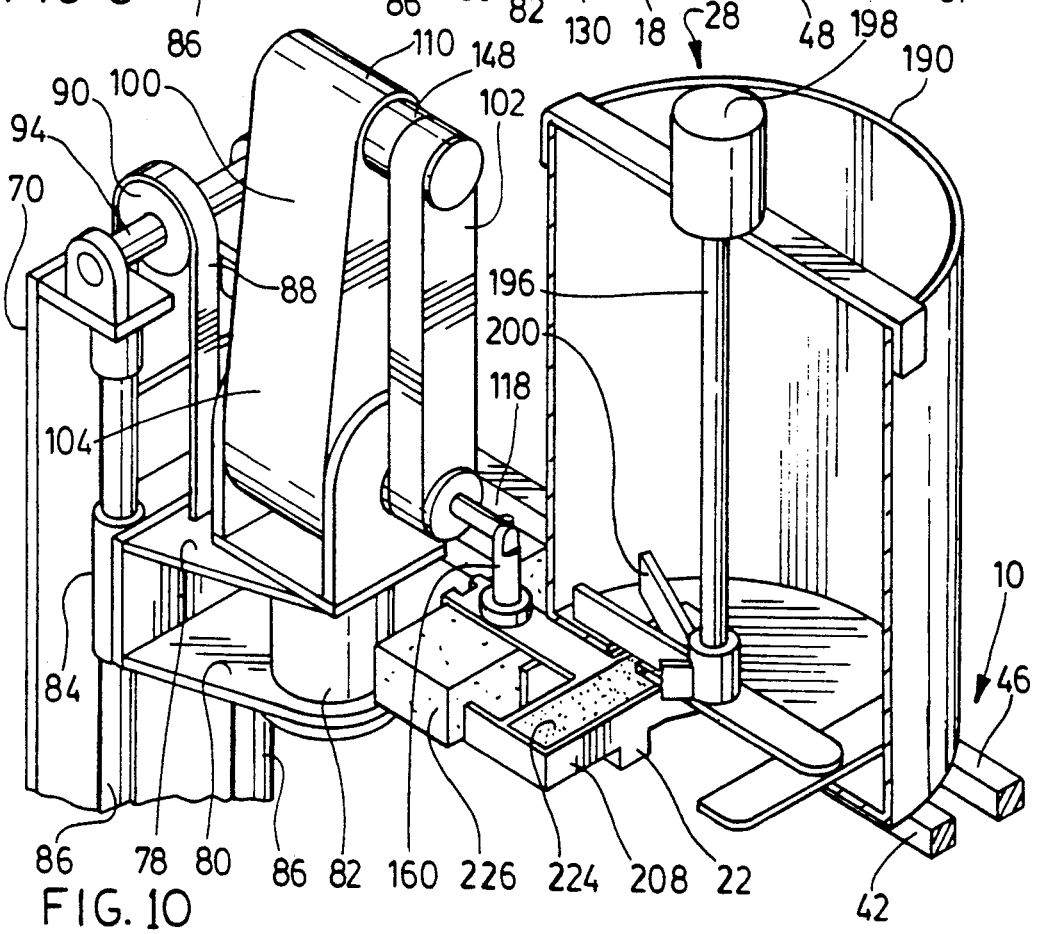
FIG. 10 is a fragmented perspective view showing the arm assembly oriented to receive a charge of mortar from the mortar carrier.
Figures 11, 12, 13:
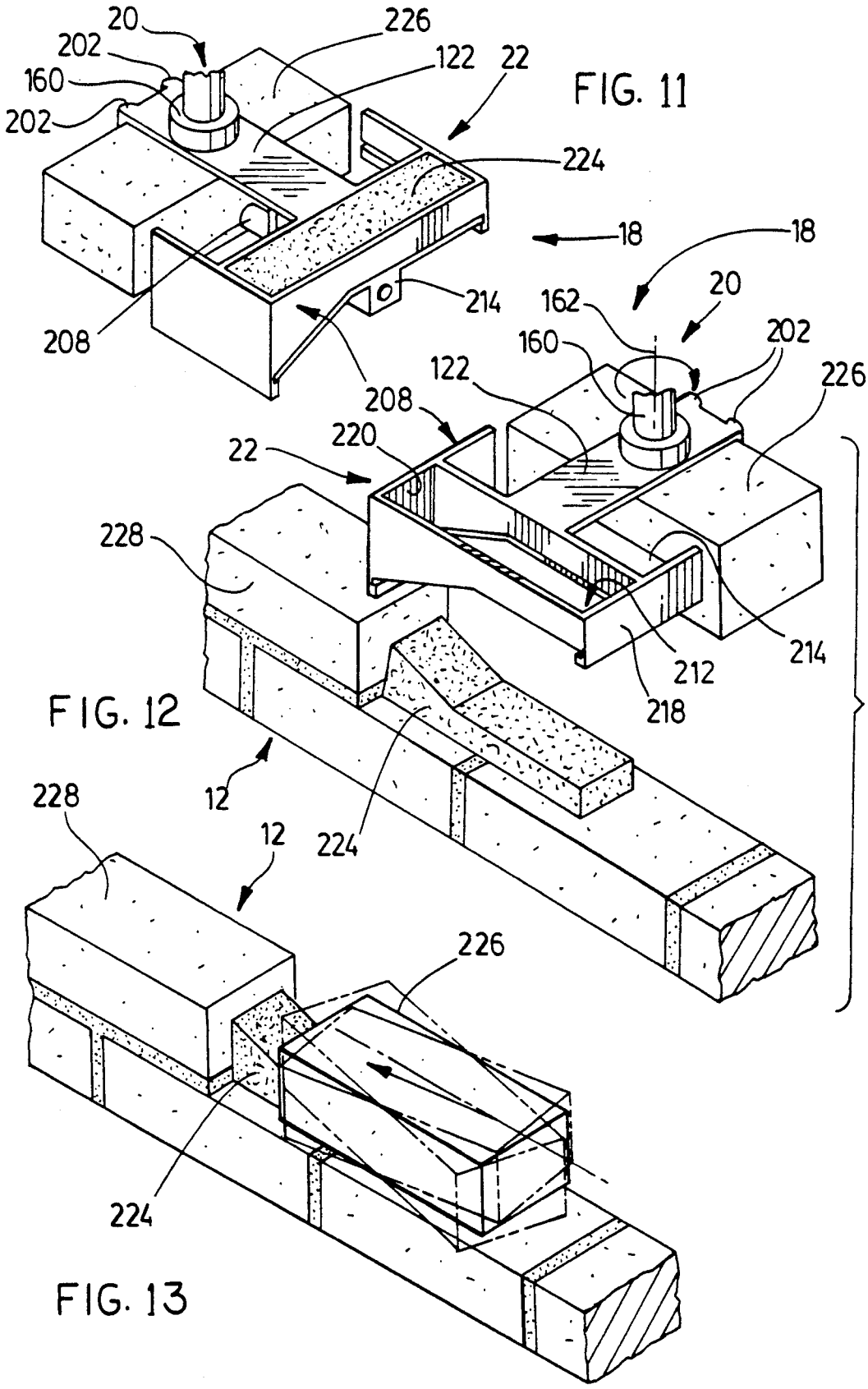
FIGS. 11-13 are fragmented perspective views showing distinct stages in the depositing of a mortar charge and placement of a brick on brick masonry.

A mortar charge 224 may initially be received from the mortar carrier 28 with the form 208 rotated and positioned in the orientation shown in FIG. 10. The arm assembly 16 displaces the tool assembly 18 until the form 208 is over the brick masonry 12, as in FIG. 12, at the position where the next brick 226 is to be placed. The gate 214 is then opened to released the charge 224. The mortar charge 224 as deposited on an upper exposed surface portion of the masonry 12 has only been shown diagrammatically in FIG. 12. What should be noted is that the deposited charge 224 is thicker proximate to the last brick 228 laid, which extends upwardly on one lateral side of the upper surface portion where the mortar charge 224 is deposited. As the next brick 226 is placed, it is rotated back-and-forth about the vertical axis 162 at the wrist joint 118. The arm assembly 16 simultaneously swings the brick 226 horizontally through an arc corresponding to the length of the thicker deposited part of the mortar charge 224. This action spreads the mortar on the subjacent bricks and also presses the thicker deposit against the brick 228 previously laid, completing the vertical joint between the brick 226, 228.

Horizontal positioning of a brick involves a novel sensing arrangement. A conventional ultrasonic distance sensor 230 is mounted to the carriage 70, and the mason's line 24 is arranged to be substantially at the same height as the sensor 230. The sensor 230 produces a signal indicating the distance from its point of attachment on the carriage 70 to the mason's line 24. That signal will indicate the horizontal distance through which the arm assembly 16 must be extended relative to the carriage 70 to position the brick-gripping mechanism 20 above the masonry 12. The horizontal distance of the brick-gripping mechanism 20 relative to the carriage 70 is a direct function of the angle through which the upper arm 100 is pivoted relative to vertical by the shoulder motor 128 ($\phi$ in FIG. 4). That angle and consequently the horizontal distance is sensed in a conventional manner with the optical encoder 145 associated with the motor 128 as the arm assembly 16 is extended toward the masonry 12. The controller 32 may control extension of the arm assembly 16 by simply comparing the two sensed horizontal distances, to position the brick-gripping mechanism 20 horizontally over the masonry 12. The mortar-dispensing mechanism 22 can be similarly positioned horizontally for depositing of a mortar charge, distance calculations being adjusted to reflect differences in operative positions of the gripping mechanism 20 and mortar-dispensing mechanism 22 on the frame 122. This arrangement accommodates variations in horizontal spacing of the guideway 10 relative to the masonry 12.

Another ultrasonic distance sensor 232 is attached to the mounting assembly 160 and displaces with the tool assembly 18. When the brick-gripping mechanism 20 has been horizontally positioned for brick placement, it produces a signal indicating the vertical distance from the brick-gripping mechanism 20 to the mason's line 24. Technically, downward displacement of the support 78 to position a brick vertically on the masonry 12 can be controlled in response to the optical encoder associated with the motor 98. However, the sensor 232 provides a more precise distance indication for this critical aspect of brick placement. The controller 32 simply controls the motor 98 in a conventional manner in response to the sensor 232 to vertically position a brick on the masonry 12. This arrangement accommodates variations in the vertical position of the guideway 10. The mortar-dispensing mechanism 22 need only be roughly positioned vertically, which can be done entirely in response to the optical encoder associated with the motor 98. Whether the sensor 232 is then properly positioned to detect vertical distance to the mason's line 24 is not critical.

Figure 17:
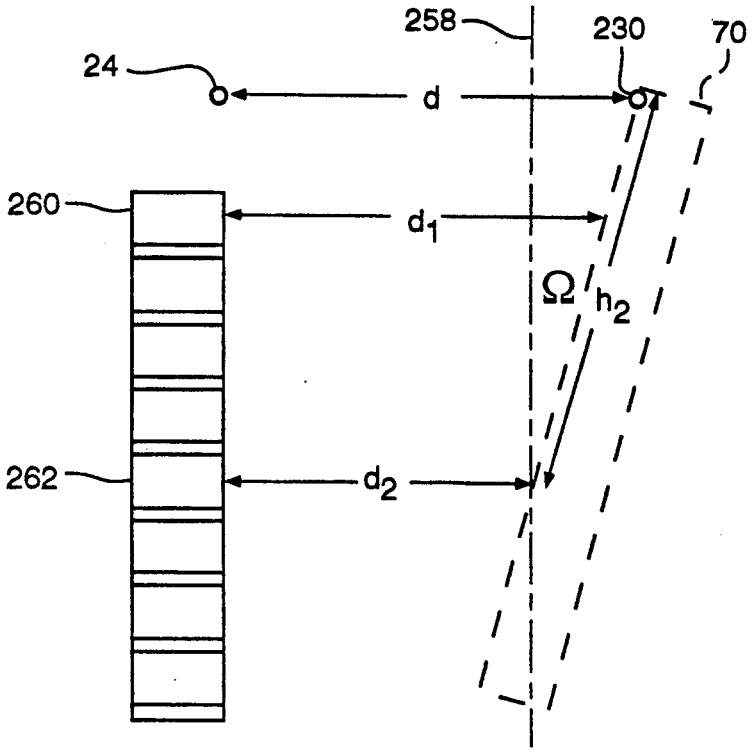
FIG. 17 diagrammatically illustrates how signals from attitude sensors mounted on the carriage of the bricklaying machine can be used to adjust sensed horizontal distance to a mason's line during horizontal positioning of bricks in a direction perpendicular to the brick masonry; and, FIG. 18 diagrammatically illustrates how signals from the attitude sensors can be used to adjust the sensed position of the carriage of the bricklaying machine on its guideway during horizontal positioning of bricks in a direction along the brick masonry.

Conventional attitude sensors 234 may be mounted on the carriage 70 of the bricklaying machine 14 to produce signals indicating inclination of the carriage 70 relative to vertical in mutually perpendicular planes. To simplify calculations, one plane will normally be oriented perpendicular to the brick masonry 12 and the other, parallel to the brick masonry 12. Use of the sensor signals for adjustment of the horizontal distance through which the arm assembly 16 must displace a brick toward the masonry 12 will be discussed with reference to FIG. 17. In FIG. 17, the carriage 70 of the bricklaying machine 14 has been diagrammatically illustrated in simplified form as a phantom rectangle and the mason's line 24 and ultrasonic sensor 230 as circles. The carriage 70 is shown inclined at an angle Ω relative to a vertical axis 258, in a vertical plane perpendicular to the masonry 12. The distance sensor 230 indicates a distance d from the carriage 70 to the mason's line 24, but upper and lower bricks 260, 262 (arbitrarily selected) are actually at shorter horizontal distances $d_1$ and $d_2$ from the carriage 70. The adjusting factor which must be subtracted from the value d to arrive at the horizontal distance to any particular brick is, to a first approximation, h sin Ω, where h is the vertical distance in the reference frame of the carriage 70 between the sensor 230 and the height at which the brick must be laid. The relevant brick height relative to the carriage 70 is a value which is set by the algorithm operating the machine 14 and which is sensed with optical encoders associated with the motor 98 that raises and lowers the arm assembly 16. The height of the sensor 230 on the carriage is a fixed quantity, which together with the expected brick height, yield the value h. For example, with respect to the lower brick 262, the illustrated geometry will indicate that the horizontal distance $d_2$ through which the arm assembly must displace the brick 262 relative to the carriage 70 is just the sensed horizontal distance d reduced by $h_2$ sin Ω, where $h_2$ is the height of the sensor 230 relative to the required horizontal position of the brick 262.

Figure 18:
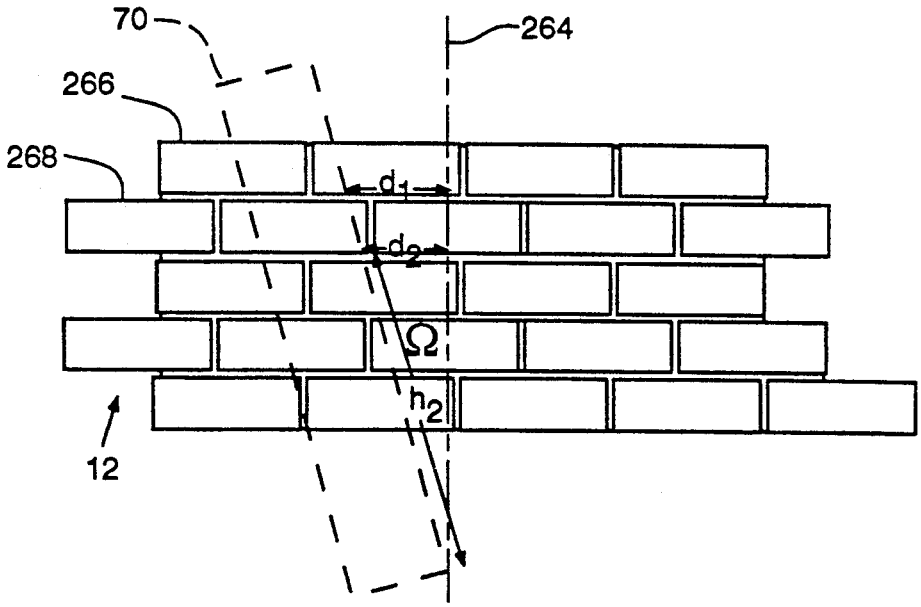

The manner in which the attitude sensors 234 are used adjust the horizontal position at which a brick is placed by the arm assembly 16 in the plane of the brick masonry is similar and will be discussed with reference to FIG. 18. A horizontal position signal for brick placement (the position of the carriage 70 along the guideway 10) is derived from the magnetically encoded power bars associated with the guideway 10. In FIG. 18, the carriage 70 of the bricklaying machine 14, diagrammatically illustrated and simplified, is shown inclined at an angle Ω relative to a vertical axis 264, in a plane parallel to the brick masonry 12. The vertical axis 264 may be assumed, for sake of simplicity, to be horizontally positioned at the sensed horizontal position of the carriage 70 along the guideway 10. Two bricks 266, 268 are specifically indicated in the masonry 12. Assuming the same angle of inclination Ω in the placement of each brick 266 or 268, relying solely on horizontal position derived from the guideway 10, the bricks 266, 268 would be mispositioned by horizontal distances $d_1$ and $d_2$. The adjusting factor which must be subtracted from the sensed position of the carriage 70 relative to the track to properly position bricks horizontally in the plane of the masonry 12 corresponds, in a first approximation, to h sin Ω where h is now the vertical distance in the reference frame of the carriage 70 between the magnetically encoded bars of the guideway 10 and the height at which the brick must be laid. The relevant brick height is once again a value which is set by the algorithm operating the machine 14 and which is sensed with optical encoders associated with the motor 98 that raises and lowers the arm assembly 16. The position of the guideway 10 is fixed, which together with the expected brick height, yields the value h. With respect to the brick 268, for example, the illustrated geometry indicates that the horizontal distance $d_2$, the required correcting factor, is $h_2$ sin Ω.

The inclination angles Ω indicated in FIGS. 17 and 18 have been grossly exaggerated for purposes of illustration. A reasonable effort must be made to orient the guideway 10 so that the carriage 70 is near vertical at all times. Minor variations from a vertical orientation can be compensated with the techniques described above, but the particular arm assembly 16 described above does not have sufficient freedom of movement (particularly at its wrist joint 118) to produce acceptable results with severe inclination.

The controller 32 is microprocessor-based, and operated according to software algorithms appropriate for construction of particular building structures. The art of programming robotic mechanisms to perform sequential operations is well-developed, and how the controller 32 should be programmed will consequently be apparent from the foregoing description of the bricklaying machinery. An exemplary sequence of steps in the operation of the bricklaying machine 14 will be briefly described to assist in such matters.

Figure 9:
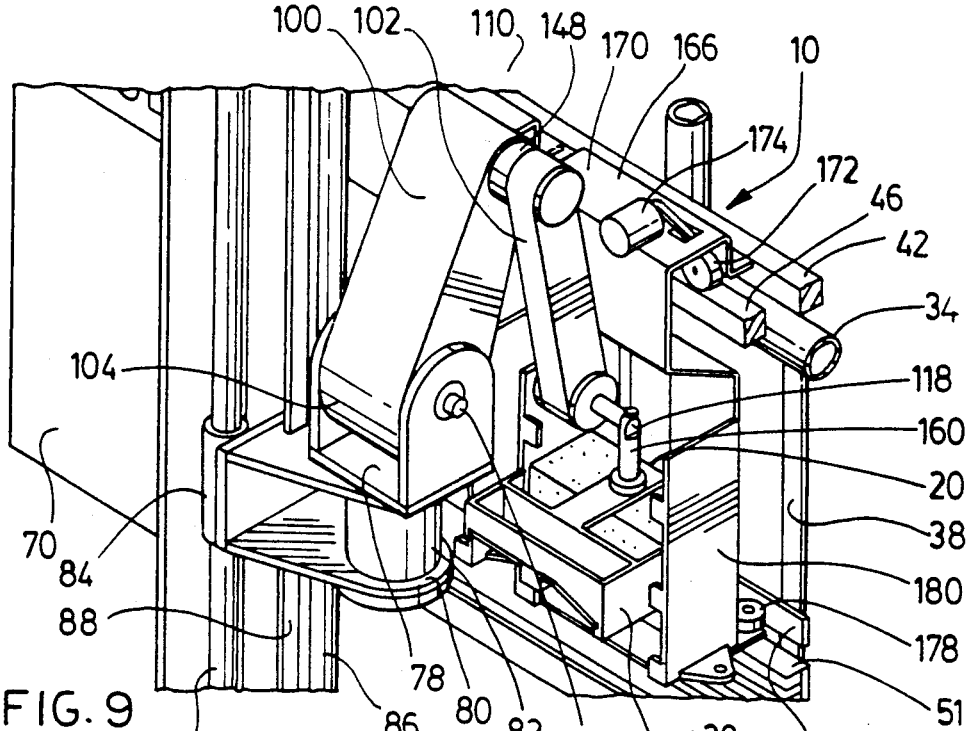
FIG. 9 is a fragmented perspective view showing the arm assembly oriented to receive a brick from the brick train.

It will be assumed that a brick has just been placed on the masonry 12, and that the brick tractor unit 166 is the brick-transferring position, as in FIG. 9. The arm assembly 16 is raised vertically to position the tool assembly 18 at a predetermined height appropriate to clear the top of the brick retainer 180. The bricklaying machine 14, the brick train 26 and the mortar carrier 28 may then be displaced along the guideway a distance corresponding to the length of a brick. The tool assembly 18 is rotated through 180 degrees so that the brick-gripping mechanism 20 is facing toward the brick retainer 180, and the upper arm 100 is simultaneously pivoted in a negative angular direction to displace the tool assembly 18 horizontally until the brick-gripping mechanism 20 is a predetermined distance behind the carriage 70. That distance is pre-calculated to place the brick-gripping mechanism 20 immediately above the brick retainer 180 (in the predetermined brick-transferring position). The tool assembly 18 is then lowered until the brick-gripping mechanism 20 engages the uppermost brick in the stack of bricks 182, as in FIG. 9. A conventional limit switch (not illustrated) may be mounted on the frame 122 to detect contact. The movable finger 204 is then displaced to grip the upper brick. The tool assembly 18 is then raised back to the predetermined height required to clear the brick retainer 180. The arm assembly 16 is then pivoted in a positive angular direction about the shoulder axis 108 substantially to its rest position with the upper arm 100 and forearm 102 vertical, and the tool assembly 18 is rotated 90 degrees to align the form 208 with the discharge opening 212 of the mortar carrier's container 190. The tool assembly 18 is then raised to another predetermined height expected to place the form 208 just below the discharge opening 212 of the mortar container 190, as in FIG. 10. The controller 32 of the bricklaying machine 14 then actuates the motor 198 of the mortar carrier 28 to open the gate 194 and to agitate the contents of the container 190, to discharge mortar to the form 208, for a predetermined period of time. The form 208 is preferably dimensioned to hold a quantity of mortar sufficient to lay one brick, when completely filled, and the upper surface of the form 208 is held substantially flush against the bottom of the mortar container 190 to avoid spillage when the form 208 is full. The time period may be empirically determined to ensure that the mortar charge 224 completely fills the form 208. It should be noted that manual finishing of the masonry 12 to remove mortar protruding between bricks is expected.

The arm assembly 16 may then be extended and the tool assembly 18 simultaneously rotated through 90 degrees to position the form 208 above the next brick-placing position in the masonry 12. The tool assembly 18 is then lowered to position the form 208 a short distance above the upper surface of the brick masonry 12, and the gate 214 is opened momentarily to release the mortar charge and then closed. The arm assembly 16 may then be retracted a short distance to clear the tool assembly 18 for rotation, assuming wood framing (not illustrated) is positioned behind the masonry 12. The tool assembly 18 is then rotated through 180 degrees, effectively to interchange the brick-gripping mechanism 20 and the mortar-dispensing mechanism 22. The arm assembly 16 is then extended to position the brick-gripping mechanism 20 above the deposited mortar charge. The arm assembly 16 is then swung horizontally away from the last brick laid to prepare for mortar spreading, and lowered until the gripped brick contacts the deposited mortar. The gripped brick is then swung horizontally toward the last brick laid with appropriate rotation of the brick by means of the motor 164 to ensure even spreading. The various steps can then be repeated or varied according to the shape of the masonry 12.

Bricks can be laid at corners of the masonry 12. FIGS. 14 and 15 show corner configurations in the brick masonry 12, and show the overall direction of brick displacement just before setting, exaggerated and indicated with arrows. One possible corner configuration is shown in FIG. 14. A mortar charge 236 is deposited at right angles to the last brick 238 laid, with the thicker portion 240 of the charge 236 proximate to a lengthwise side 242 of the last brick 238. The next brick 244 is positioned vertically on the thinner region of the mortar charge 236 and then swung horizontally to spread the thicker charge portion 240 against the side 242 of the last brick 238, rotating back and forth horizontally to properly spread the charge 236, all in the manner described above. A more difficult corner configuration is shown in FIG. 15, in which the last brick 246 is offset from the corner 248 by about one-half of a brick length. A mortar charge 250 is deposited once again at right angles to the last brick 246, but with the thicker portion 252 at the end surface 254 of the last brick 246. The next brick 256 cannot simply be swung into place as before. Instead, the arm assembly 16 is manipulated to displace the next brick 256 horizontally at an appropriate height to spread the thicker portion 252 of the mortar charge against the end surface 254 of the last brick 246 and to spread mortar below the brick 256. The ultrasonic distance sensor 232 can be used to ensure proper vertical positioning of the brick 256 for such purposes, despite some horizontal offsetting of the sensor 232 relative to the mason's line 254. Rotation of the brick 256 for purposes of mortar spreading must be stopped as the brick 256 approaches the last brick 246. Subsequent manual finishing may be required.

The invention has been described in the context of forming a brick structure essentially as part of a building. Navigation relative to a mason's line is important in such applications. However, the invention can also be used to construct partitions or other structures that are simply installed at a remote location as pre-assembled units. In such applications, precision tracks can be readily provided for repetitive construction of predetermined structures using the bricklaying machinery described. The carriage 70 can be simplified accordingly. Alternatively, the brick masonry may be displaced horizontally relative to the bricklaying machinery. It is possible to use separate robotic mechanisms to displace the brick-gripping mechanism 20 and mortar-dispensing mechanism 22 in such applications. Manipulating the tool assembly 18 as a single unit with a single robotic arm simplifies control, and is strongly preferred for general construction of buildings on site.

It will be appreciated that particular embodiments of the invention have been described and that modifications may be made therein without departing from the spirit of the invention or necessarily departing from the scope of the appended claims.

We claim:

1. Apparatus for use in laying bricks on brick masonry, comprising:

a frame;

a tool assembly comprising a controllable mechanism for gripping a brick and a mechanism for dispensing a charge of mortar, the mortar-dispensing mechanism comprising a form for receiving and shaping the mortar charge, a discharge opening in the form, a gate mechanism having a closed orientation in which the gate mechanism closes the discharge opening and an open orientation in which that gate mechanism releases the shaped charge through the discharge opening, and controllable means for displacing the gate mechanism between its open and closed orientations; and, controllable tool-displacing means secured to the frame and to the tool assembly for displacing the tool assembly relative to the frame.

2. The apparatus of claim 1 in which the tool-displacing means include an arm assembly comprising:

a support mounted on the frame;

a first arm member with first and second end portions;

a second arm member with first and second end portions;

means defining a first pivot joint between the first end portion of the first arm member and the support, the first pivot joint permitting the first arm member to pivot relative to the support about a first generally horizontal pivot axis;

motor means for pivoting the first arm member about the first pivot axis relative to the support;

means defining a second pivot joint between the first end portion of the second arm member and the second end portion of the first arm member, the second pivot joint permitting the second arm member to pivot about a second generally horizontal pivot axis relative to the first arm member, the second pivot axis being substantially parallel to the first pivot axis; and, means defining a third pivot joint between the tool assembly and the second end portion of the second arm member, the third pivot joint permitting the tool assembly to pivot about a third generally horizontal pivot axis relative to the second arm member, the third pivot axis being substantially parallel to the first and second pivot axes; and, linkage means constraining pivoting movement of the arm members such that the third pivot joint displaces substantially along an axis extending perpendicularly through the first pivot axis in response to pivoting of the first arm member about the first pivot axis.

3. The apparatus of claim 2 in which the linkage means comprise:

a first pulley assembly aligned with the first pivot axis and fixed to the support;

a first rotating member aligned with the second pivot axis and fixed to the first end portion of the second arm member;

means supporting the first rotating member from the first arm member for rotation about the second pivot axis; and, a second pulley assembly fixed to the first rotating member; and, a pair of flexible straps formed of a material which resists lengthwise-extension, each of the straps extending in a taut state between the first and second pulley assemblies and being positioned to a different side of a plane containing the first and second pivot axes, each of the straps having a first end portion fixed to the first pulley assembly and a second end portion fixed to the second pulley assembly such that the first rotating member rotates in response to pivoting of the first arm member about the first pivot axis.

4. The apparatus of claim 3 in which:

the first end portion of each of the straps engages a generally cylindrical surface of a first predetermined diameter defined by the first pulley assembly;

the second end portion of each of the straps engages a generally cylindrical surface of a second predetermined diameter defined by the second pulley assembly, the second diameter being substantially one-half of the first diameter; and, the distance between the first and second pivot axes is substantially equal to the distance between the second and third pivot axes.

5. The apparatus of claim 2 in which the linkage means maintain a fixed angular orientation of the tool assembly relative to vertical, the linkage means comprising:

means coupling the second pivot joint to the first pivot joint such that, in response to pivoting of the first arm member through any angular increment in either angular direction about the first pivot axis, the second arm member pivots about the second pivot axis relative to the first arm member in an opposite angular direction through substantially twice the angular increment; and, means coupling the third pivot joint to the first pivot joint such that, in response to the pivoting of the first arm member through the angular increment, the tool assembly pivots about the third pivot axis relative to the second arm member in the same angular direction as the first arm member pivots.

6. The apparatus of claim 5 in which:

the third pivot joint comprises a second rotating member aligned with the third pivot axis and means supporting the second rotating member from the second arm member for rotation about the third pivot axis; and, the apparatus comprises means mounting the tool assembly to the second rotating member for rotation with the second rotating member about the third pivot axis and for rotation about a vertical axis relative to the second rotating member and comprises controllable motor means for rotating the tool assembly about the vertical axis.

7. The apparatus of claim 1 permitting displacement of the frame horizontally relative to the masonry and adapted to respond to a solid horizontal datum located above the brick masonry, comprising:

a guideway;

means mounting the frame to the guideway for displacement horizontally along the guideway;

first sensing means responsive to operation of the displacing means for sensing horizontal distance from the brick-gripping mechanism to the frame;

second sensing means mounted to the frame for sensing horizontal distance from the frame to the datum;

third sensing means displaceable with the tool assembly for sensing vertical distance from the brick-gripping mechanism to the datum; and, control means for operating the tool-displacing means in response to the first, second and third sensing means to position a brick gripped by the gripping mechanism on the brick masonry.

8. The apparatus of claim 1 in which the gate mechanism comprises:

a gate;

means mounting the gate to the form for sliding movement between the closed and open orientations; and, means for sliding the gate between the closed and open orientations.

9. The apparatus of claim 1 in which the form comprises an elongate circumferential sidewall defining a pair of end walls and the form is shaped to accumulate the charge to a greater depth proximate to one of the pair of end walls whereby the charge can be deposited on an upper surface portion of the brick masonry to a greater depth proximate to a brick extending upwardly at one lateral side of the upper surface portion.

10. The apparatus of claim 1 in which the form has an upper opening for receiving the mortar charge, the apparatus comprising:

a container for storing the mortar, the container comprising a discharge opening, the container being separate from the tool assembly and the displacing means such that the displacing means can be operated to position the form below the discharge opening of the container;

a gate mechanism attached to the container and having a closed orientation closing the discharge opening of the container and an open orientation allowing the stored mortar to discharge from the container;

controllable means for selectively displacing the gate mechanism attached to the container between its open and closed orientations; and, means for agitating the stored mortar when the gate mechanism attached to the container is in its open orientation thereby to encourage a flow of mortar under gravity from the discharge opening.

11. The apparatus of claim 10 in which the agitating means comprise:

a motor mounted to the container and selectively rotatable in opposing angular directions;

a shaft located within the container and connected to the motor for rotation therewith; and, an assembly of vanes extending transversely from the shaft within the container.

12. The apparatus of claim 1 comprising:

a guideway;

means mounting the frame to the guideway for displacement along the guideway; and, a brick carrier comprising a frame, a brick retaining structure mounted on the frame and shaped to retain bricks, means mounting the frame to the guideway for displacement along the guideway, and controllable motor means for propelling the frame along the guideway to and from a predetermined brick-transferring position relative to the tool-displacing means.

13. The apparatus of claim 12 comprising a mortar carrier, the mortar carrier comprising:

a frame;

a container mounted on the frame for storing mortar, the container comprising a discharge opening;

means mounted on the container for controlling discharge of the stored mortar from the container;

means mounting the frame of the mortar carrier to the guideway for displacement along the guideway;

controllable motor means for propelling the frame of the mortar carrier along the guideway to and from a predetermined mortar-transferring position relative to the tool-displacing means.

14. In machinery for laying bricks, means for placing mortar on an upper exposed surface of brick masonry, comprising:

a mortar-dispensing mechanism comprising:

(a) a form for receiving and shaping a charge of the mortar, the form comprising an opening for discharging the shaped charge, (b) a gate mechanism having a closed orientation in which the gate mechanism closes the discharge opening and an open orientation in which the gate mechanism releases the shaped mortar charge through the discharge opening, and (c) controllable means for displacing the gate mechanism between its open and closed orientations; and, means for positioning the mortar-dispensing mechanism over the brick masonry.

15. The apparatus of claim 14 in which:

the form has a circumferential sidewall defining a pair of horizontally spaced-apart end walls, the sidewall defining an upper opening above the discharge opening for receiving the mortar charge;

the gate mechanism defines a surface supporting the mortar charge in the closed orientation of the gate mechanism; and, the surface extends downwardly and laterally proximate to one of the end walls thereby to accumulate the charge to a greater depth proximate to the one end wall.

16. The apparatus of claim 14 in which the gate mechanism comprises:

a gate; and, means mounting the gate to the form for sliding movement between the closed and open orientations.

means for sliding the gate between the closed and open orientations.

17. The apparatus of claim 16 in which the form comprises an elongate circumferential sidewall defining a pair of end walls and is shaped to accumulate the charge to a greater depth proximate to one of the pair of end walls such that the charge can be deposited on an upper exposed surface portion to a greater depth proximate to a brick extending upwardly at one lateral side of the upper surface portion.

18. The apparatus of claim 14 in which the form has an upper opening for receiving the mortar charge and the apparatus comprises:

a container for storing the mortar, the container comprising a discharge opening;

a gate mechanism attached to the container and having a closed orientation closing the discharge opening of the container and an open orientation allowing mortar to discharge through the discharge opening of the container; and, controllable means for displacing the gate mechanism attached to the container between its open and closed orientations; and, means for agitating the mortar stored in the container when the gate mechanism attached to the container is in its open orientation thereby to encourage a flow of mortar under gravity from the discharge opening of the container;

the positioning means being adapted to displace the mortar-dispensing mechanism between the brick masonry and a predetermined position relative to the container in which the upper opening of the form is positioned below the discharge opening of the container.

19. The apparatus of claim 18 in which the agitating means comprise:

a motor mounted to the container and selectively rotatable in opposing angular directions;

a shaft located within the container and connected to the motor for rotation therewith; and, an assembly of vanes extending transversely from the shaft within the container.

20. The apparatus of claim 18 comprising:

a guideway;

a frame supporting the mortar container;

means mounting the frame to the guideway for displacement horizontally along the guideway; and, controllable motor means for propelling the frame along the guideway to and from a predetermined mortar-transferring position relative to the positioning means.

21. A mechanism for use in placing bricks on brick masonry, the mechanism comprising a frame, a support, means for displacing the support relative to the frame, a tool assembly comprising at least a controllable brick-gripping mechanism, and an arm assembly, the arm assembly comprising:

a first arm member with first and second end portions;

a second arm member with first and second end portions;

means defining a first pivot joint between the first end portion of the first arm member and the support, the first pivot joint permitting the first arm member to pivot relative to the support about a first generally horizontal pivot axis;

motor means for pivoting the first arm member about the first pivot axis relative to the support;

means defining a second pivot joint between the first end portion of the second arm member and the second end portion of the first arm member, the second pivot joint permitting the second arm member to pivot about a second generally horizontal pivot axis relative to the first arm member, the second pivot axis being substantially parallel to the first pivot axis; and, means defining a third pivot joint between the tool assembly and the second end portion of the second arm member, the third pivot joint permitting the tool assembly to pivot about a third generally horizontal pivot axis relative to the second arm member, the third pivot axis being substantially parallel to the first and second pivot axes;

linkage means constraining pivoting movement of the arm members such that the third pivot joint displaces substantially along an axis extending perpendicularly through the first pivot axis in response to pivoting of the first arm member about the first pivot axis.

22. The mechanism of claim 21 in which the linkage means comprise:

a first pulley assembly aligned with the first pivot axis and fixed to the support;

a first rotating member aligned with the second pivot axis and fixed to the first end portion of the second arm member;

means supporting the first rotating member from the first arm member for rotation about the second pivot axis; and, a second pulley assembly fixed to the first rotating member; and, a pair of flexible straps formed of a material which resists lengthwise-extension, each of the straps extending in a taut state between the first and second pulley assemblies and being positioned to a different side of a plane containing the first and second pivot axes, each of the straps having a first end portion fixed to the first pulley assembly and a second end portion fixed to the second pulley assembly such that the first rotating member rotates in response to pivoting of the first arm member about the first pivot axis.

23. The mechanism of claim 22 in which:

the first end portion of each of the straps engages a generally cylindrical surface of a first predetermined diameter defined by the first pulley assembly;

the second end portion of each of the straps engages a generally cylindrical surface of a second predetermined diameter defined by the second pulley assembly, the second diameter being substantially one-half of the first diameter; and, the distance between the first and second pivot axes is substantially equal to the distance between the second and third pivot axes.

24. The mechanism of claim 21 in which the linkage means maintain a fixed angular orientation of the tool assembly relative to vertical, the linkage means comprising:

means coupling the second pivot joint to the first pivot joint such that, in response to pivoting of the first arm member through any angular increment in either angular direction about the first pivot axis, the second arm member pivots about the second pivot axis relative to the first arm member in an opposite angular direction through substantially twice the angular increment; and, means coupling the third pivot joint to the first pivot joint such that, in response to the pivoting of the first arm member through the angular increment, the tool assembly pivots about the third pivot axis relative to the second arm member in the same angular direction as the first arm member pivots.

25. The mechanism of claim 24 in which:

the third pivot joint comprises a second rotating member aligned with the third pivot axis and means supporting the second rotating member from the second arm member for rotation about the third pivot axis; and, the apparatus comprises means mounting the tool assembly to the second rotating member for rotation with the second rotating member about the third pivot axis and for rotation about a vertical axis relative to the second rotating member and comprises controllable motor means for rotating the tool assembly about the vertical axis.

26. The mechanism of claim 25 in which the tool assembly includes a mortar-dispensing mechanism comprising:

a form for receiving and shaping a charge of mortar, the form comprising an opening for discharging the shaped mortar charge; and, controllable means attached to the form for controlling discharge of the shaped charge through the discharge opening.

27. Apparatus for use in placing a brick on brick masonry and responsive to a horizontally-extending datum above the brick masonry, comprising:

a guideway;

a carriage displaceable horizontally along the guideway;

a controllable brick-gripping mechanism for receiving and releasably gripping the brick;

displacing means mounted to the carriage for displacing the brick-gripping mechanism relative to the carriage;

first sensing means responsive to operation of the displacing means for sensing the horizontal distance between the brick-gripping mechanism and the carriage;

second sensing means mounted to the carriage for sensing the horizontal distance between the carriage and the datum; and, control means for operating the displacing means in response to the first and second sensing means to position the gripped brick on the brick masonry.

28. The apparatus of claim 27 further comprising attitude sensing sensor for sensing the angular orientation of the carriage relative to vertical, the control means operating the displacing means in response to the sensed angular orientation to position the gripped brick on the brick masonry.

29. The apparatus of claim 27 comprising third sensing means displaceable with the brick-gripping mechanism for sensing the vertical distance from the brick-gripping mechanism to the datum, the control means operating the displacing means in response to the third sensing means to vertically position the gripped brick relative to the brick masonry.

30. The apparatus of claim 27 in which:

the carriage comprises means for displacing the carriage along the guideway;

the guideway comprises distance-indicating means extending along the guideway; and, the carriage comprises transducing means responsive to the distance-indicating means for sensing the position of the carriage along the guideway.

31. Apparatus for use in placing bricks on brick masonry, comprising:

a guideway;

a brick carrier comprising a first carriage, a brick retaining structure mounted on the first carriage for retaining bricks in a predetermined orientation, means mounting the first carriage to the guideway for displacement horizontally along the guideway, and first carriage-displacing means for displacing the first carriage horizontally along the guideway;

a bricklaying assembly comprising a second carriage, means mounting the second carriage to the guideway for displacement horizontally along the guideway, second carriage-displacing means for displacing the second carriage along the guideway, and a robotic mechanism mounted on the second carriage, the robotic mechanism including a tool assembly comprising a at least a controllable brick-gripping mechanism and tool-displacing means for displacing the tool assembly, when the first carriage is in a predetermined brick-transferring position relative to the second carriage, between the brick-retaining structure to receive a brick retained by the brick-retaining structure and the brick masonry to place the received brick on the brick masonry;

sensing means for sensing the position of each of the first and second carriages on the guideway; and, control means for operating the first carriage-displacing means responsive to the sensing means to displace the first carriage to and from the brick-transferring position.

32. The apparatus of claim 31 in which:

the guideway comprises a support structure, a first track comprising upper and lower rails fixed to the support structure, and a second track comprising upper and lower rails fixed to the support structure;

the first carriage is mounted on the upper and lower rails of the first track to one lateral side of the support structure;

the second carriage is mounted on the upper and lower rails of the second track on the one lateral side of the guideway; and, the carriages are so dimensioned and the tracks are so oriented that the brick carrier locates between the bricklaying assembly and the support structure in the brick-transferring position.

33. The apparatus of claim 32 in which the brick retaining structure is shaped to support the retained bricks in a vertically-aligned stack and the robotic mechanism comprises a support, means mounting the support to the second carriage for vertical displacement relative to the carriage, controllable means for displacing the support vertically relative to the carriage, and an arm assembly comprising:

a first arm member with first and second end portions;

a second arm member with first and second end portions, the first and second arm members being positioned in vertically spaced-apart planes;

means defining a first pivot joint between the first end portion of the first arm member and the support, the first pivot joint permitting the first arm member to pivot relative to the support about a first generally horizontal pivot axis;

motor means for pivoting the first arm member about the first pivot axis relative to the support;

means defining a second pivot joint between the first end portion of the second arm member and the second end portion of the first arm member, the second pivot joint permitting the second arm member to pivot about a second generally horizontal pivot axis relative to the first arm member, the second pivot axis being substantially parallel to the first pivot axis;

means defining a third pivot joint between the tool assembly and the second end portion of the second arm member, the third pivot joint permitting the tool assembly to pivot about a third generally horizontal pivot axis relative to the second arm member, the third pivot axis being substantially parallel to the first and second pivot axes; and, linkage means coupling the first, second and third joints such that the tool assembly is constrained to displace in a fixed angular relationship relative to vertical substantially along a horizontal axis.

34. The apparatus of claim 31 in which the tool assembly comprises a mortar-dispensing mechanism for receiving and discharging a charge of mortar and in which the apparatus includes a mortar carrier comprising:

a third carriage;

means mounting the third carriage to the guideway for displacement horizontally along the guideway;

a container mounted to the third carriage for storing mortar;

controllable means mounted to the container for discharging the stored mortar from the container;

means for displacing the third carriage along the guideway to and from a predetermined mortar-transferring position relative to the second carriage in which the tool-displacing means can position the mortar-dispensing mechanism for receipt of mortar from the container.

35. The apparatus of claim 31 in which the first-carriage displacing means comprise:

a tractor unit having a plurality of wheels mounted to the guideway and motor means for rotating at least one of the wheels to displace the tractor unit along the guideway; and, means forming an articulated joint between the tractor unit and the first carriage.

* * * * *